US005547413A

United States Patent [19]

Murray

[11] Patent Number: 5,547,413

[45] Date of Patent: Aug. 20, 1996

[54] HEAT-STAKED TETHER FOR TOY BALLOONS

[76] Inventor: Robert H. Murray, 52 Manor Hill Dr., Fairport, N.Y. 14450

[21] Appl. No.: 450,819

[22] Filed: May 25, 1995

[51] Int. Cl.[6] ..... A63H 27/10

[52] U.S. Cl. ..... 446/220; 446/222

[58] Field of Search ..... 446/220–226; 242/125.1, 125.2, 159, 164, 165; 244/31

[56] References Cited

U.S. PATENT DOCUMENTS 3,616,569 11/1971 Litt et al. ..... 446/220

3,871,422 3/1975 Elson et al. ..... 446/222 X 5,011,447 4/1991 Watanabe ..... 446/220

5,188,314 2/1993 Peters ..... 446/220 X

*Primary Examiner*—Mickey Yu

*Attorney, Agent, or Firm*—Howard J. Greenwald

[57] ABSTRACT

A toy balloon support assembly containing an elongated support and, attached to it, a heat-staked ribbon tether. One end of the ribbon tether is connected by heat-staking to the elongated support and is preferably parallel to its vertical axis. This end of the ribbon tether contains at least two heat-staked portions separated from each other by a non-heat-staked portion.

15 Claims, 4 Drawing Sheets

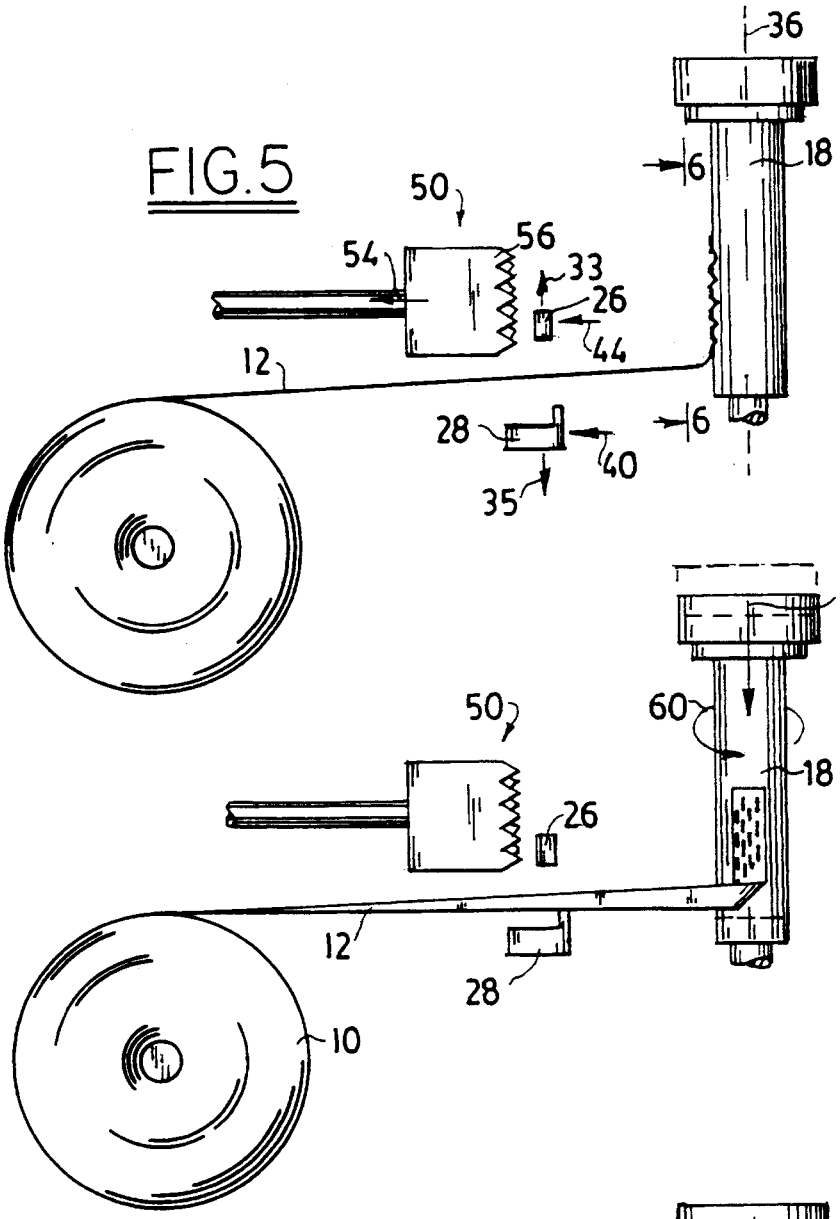
FIG.5
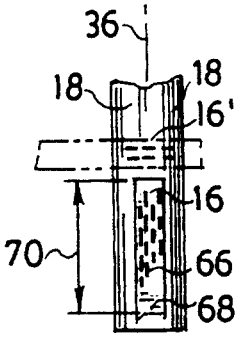
FIG.6
FIG.7
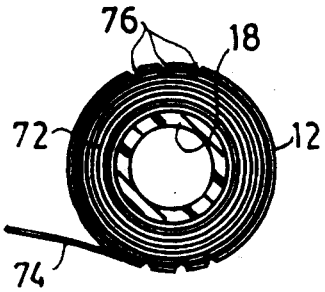
FIG.9
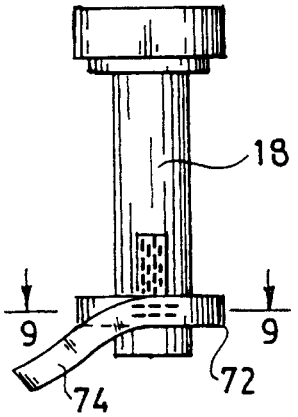
FIG.8

HEAT-STAKED TETHER FOR TOY BALLOONS

CROSS-REFERENCE TO RELATED PATENT APPLICATIONS

This application is related to U.S. patent application Ser. No. 08/218,270 entitled "Balloon Valve Assembly" and filed Mar. 25, 1994.

FIELD OF THE INVENTION

This invention is directed to toy balloons and particularly to a toy balloon support assembly including a heat-staked tether, and to a method for securing such tether.

BACKGROUND OF THE INVENTION

Helium-filled toy balloons are ordinarily lighter than air and, if not tethered, will float up into the atmosphere. This can create a nuisance in, for example, shopping malls in which balloons frequently escape, float towards the mall ceiling and, after some helium has escaped from them, descend and frequently set off alarm mechanisms.

One solution to this problem, for example, is to support the helium filled balloon on a support attached to a tether. Two of the most common ways of attaching a tether to the balloon support is by tying a string or ribbon tether to the balloon support, or by affixing such string or ribbon tether to the balloon support assembly circumferentially with a staple, as for example a balloon valve, or a balloon cup.

The problem with tying a tether to the balloon support assembly or to the balloon itself is that this is a very labor-intensive and expensive process. The problem with stapling a tether to a balloon support assembly is that, especially in environments where food is served to small children (such as, e.g., fast-food restaurants), the staples present a danger of ingestion.

Another problem of stapling a tether to a balloon support is that the additional weight of the staple will reduce the time a helium-filled balloon will remain buoyant.

Another problem encountered when attaching a tether to a balloon support assembly and then winding the tether around the support involves removably attaching the second or free end of the tether. The first end having been attached to the balloon support assembly by any means. Various methods have been used to secure the second end. e.g.; Securing with a strip of tape, tucking the end under the neck of the balloon to mention two methods. The first method adds another component and some additional weight. The second method requires that the balloon be installed on the supporting assembly as soon as the ribbon or string has been wound and therefore is not conducive to preparing tethered support assemblies in advance of balloon installation.

It is therefore an object of this invention to provide a relatively fast, inexpensive methods of attaching a tether to balloon support assembly.

It is yet another object of this invention to provide an apparatus, and a process, for securely attaching a tether to a balloon support assembly by heat-staking means.

It is yet another object of this invention to provide an apparatus whereby a ribbon tether is aligned circumferentially with a balloon support assembly and secured by heat-staking.

It is yet another object of this invention to provide an apparatus whereby a ribbon tether is aligned longitudinally with a balloon support assembly and secured by heat-staking.

It is yet another object of this invention to provide for folding a ribbon tether that has been secured longitudinally for the purpose of winding the ribbon circumferentially around a balloon support.

It is yet another object of this invention to removably secure the outer, free end of a wound ribbon tether to a toy balloon support by heat-staking.

SUMMARY OF THE INVENTION

In accordance with this invention, there is provided a toy balloon support assembly having a safe and effective heat-staked tether. The support assembly contains an elongate support member for supporting a toy balloon, which member includes a first end projecting longitudinally from the toy balloon; a ribbon tether consisting of a length of ribbon having a first end and a second end, the first end of the ribbon being aligned against the first end of the elongate member, and the first end of the ribbon, as aligned, including an area thereof heat-staked to the first end of the elongate member. The second end of ribbon being removably secured to an intermediate portion of ribbon wound on the elongate member by heat-staking. A method for producing such assembly also is provided.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIGS. 2–5 and 7 are side views of the embodiment of FIG. 1 illustrating such embodiment at various stages of the heat-staking process;

FIG. 6 is a front view of the balloon support assembly depicted in FIG. 5, viewed along lines 6—6, with ribbon tether heat-staked to it;

FIG. 8 is a side view of the balloon support assembly depicted in FIG. 7 with ribbon wound around it;

FIG. 9 is a sectional view taken through lines 9—9 of FIG. 8, showing the ribbon wound around the balloon support assembly and the outer ribbon end removably heat-staked;

DESCRIPTION OF THE PREFERRED EMBODIMENTS

Figure 1:
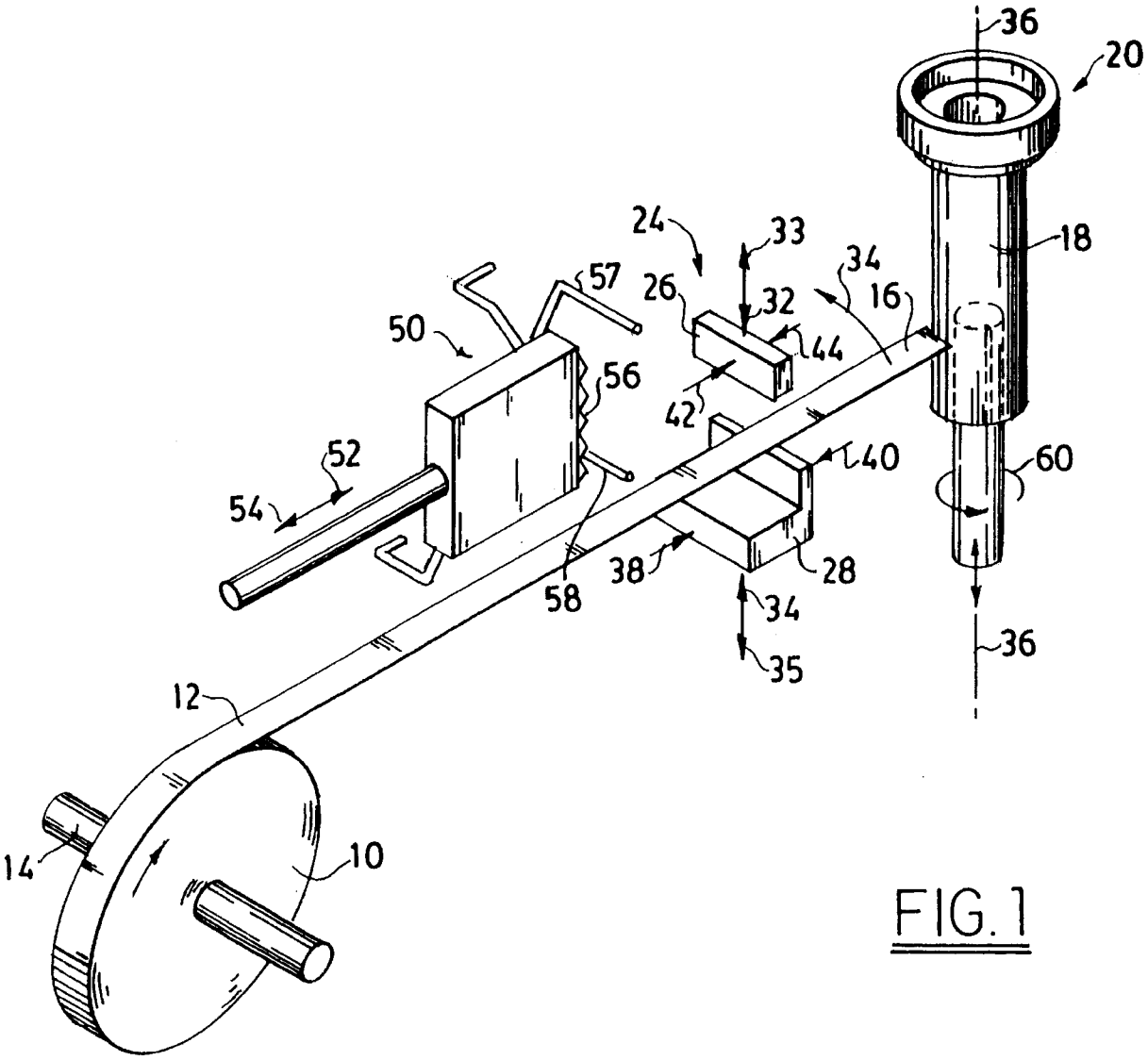
FIG. 1 is a partial perspective view of one preferred embodiment of the invention.

FIG. 1 is a partial perspective view of one embodiment of applicant's invention from which unnecessary detail has been omitted.

Referring to FIG. 1, it will be seen that a spool 10 of ribbon 12 is movably mounted on a shaft 14. As will be later described, ribbon 12 will be cut along line 75 thereby forming a length of ribbon 12'.

Ribbon 12 is preferably "curling ribbon" such as, e.g., the curling ribbon disclosed in U.S. Pat. No. 5,240,750, and the like.

In one preferred embodiment, ribbon 12 is comprised of at least about 80 weight percent of polypropylene and is sold by, e.g., the Equality Specialties, Incorporated of Chicago, Ill.

In the first step of the process, ribbon 12 is manually advanced so that its exposed end 16 is contiguous with a portion of the elongate support member 18 of balloon support assembly 20.

The term elongate support member, as used herein, refers to any assembly which may be attached to a balloon to support it before, during and after the balloon is inflated. Any of the conventional balloon support means may be used in applicant's invention. Thus, by means of illustration and not limitation, one may use one or more of the elongate balloon support means disclosed in U.S. Pat. Nos. 5,334,072, 4,661,081, 4,701,148, 4,167,204, D329,261, and the like. The disclosure of each of these United States Patents is hereby incorporated by reference into this specification.

In the preferred embodiment depicted in FIG. 1, elongate support member 18 is a tube in the shape of stepped bore.

The term "heat-staking", as used herein, refers to a process in which materials which are substantially similar are placed in contact with each other, and heat applied to selected portions of such material to cause a melting or partial melting of both materials, thereby creating a bonding action primarily at the perimeter of each melted portion.

Referring again to FIG. 1, it will be seen that, at this point in the process, a clamp assembly 24 (which is comprised of an upper jaw 26 and a lower jaw 28) is disposed both above and below ribbon 12.

Figure 2:
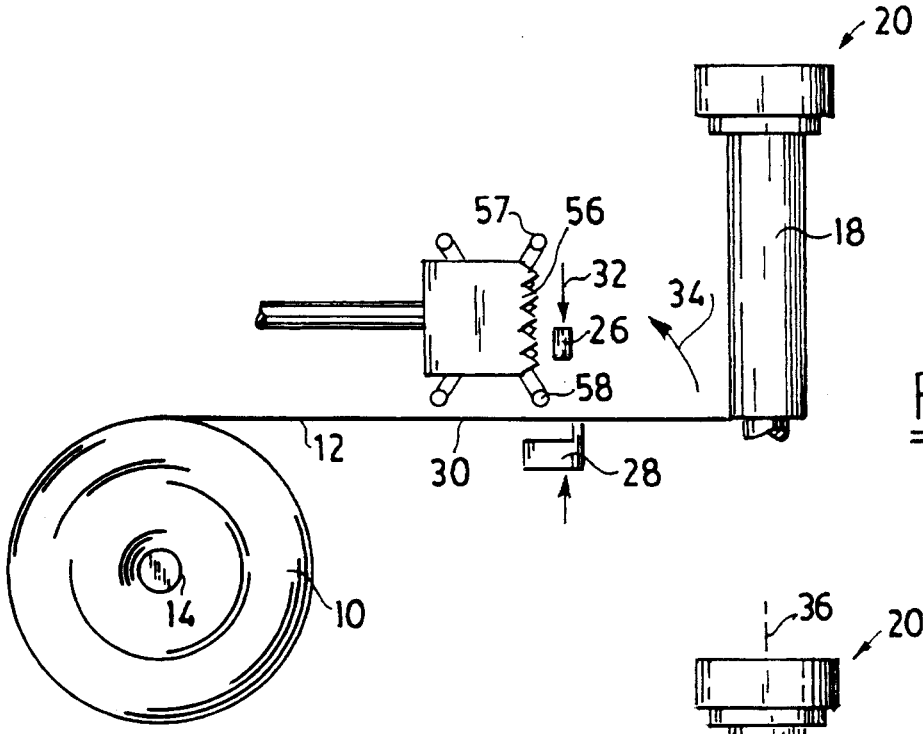
Figure 3:
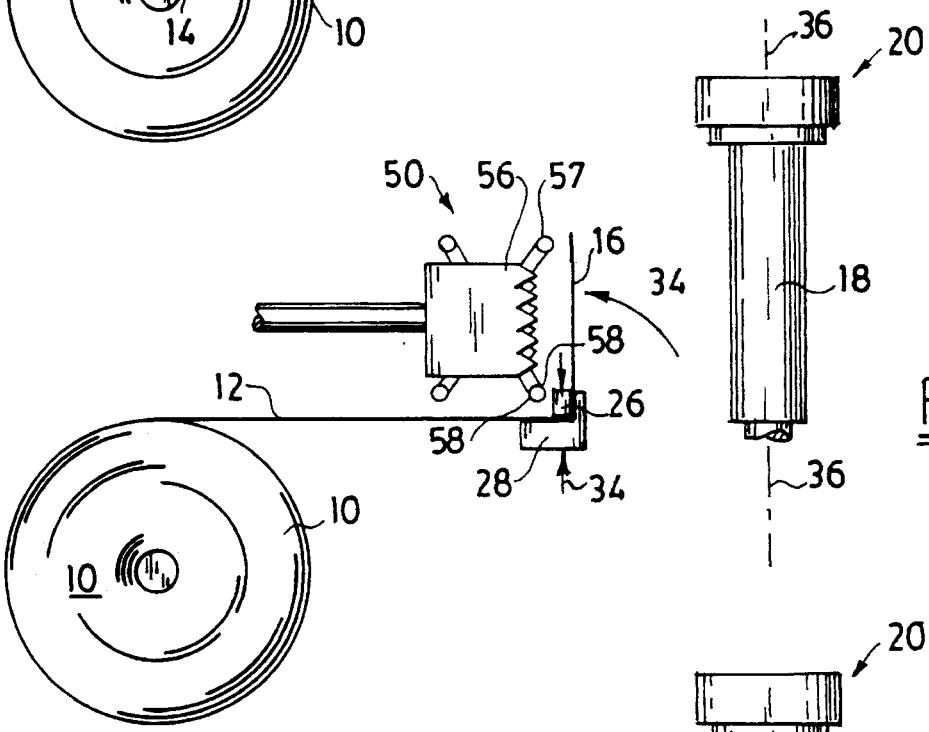

Referring to FIG. 2, and in the preferred embodiment illustrated therein, it will be seen that lower jaw 28 is preferably L-shaped so that, when ribbon 12 is impinged against it, the ribbon 12 is caused to fold upwardly in the direction of arrow 34 at about a 90 degree angle (see FIG. 3.

A side view of this position is shown in FIG. 2. It should be noted that, at this point in the process (and at all subsequent points), jaw 28 is preferably fixed in position relative to ribbon 12, and is preferably in close proximity to the bottom surface 30 of ribbon 12.

Now, in order to grasp ribbon 12 between jaws 26 and 28, jaw 26 is moved in the direction of arrow 32 until ribbon 12 is impinged between the jaws 26 and 28 and caused to bend upwardly in the direction of arrow 34.

Referring to FIG. 3, at this point in the process the free or first end 16 of ribbon 12 is positioned and aligned substantially parallel to the vertical axis 36 of balloon support device 20. As will be apparent to those skilled in the art, the free, first end 16 of ribbon 12 now is in a position to be moved closer to the support device 20 prior to being heated-staked to such device 20.

Referring to FIG. 1, it will be seen that jaws 26 and 28 are attached to means (not shown) for moving them in a substantially horizontal direction, in the directions of arrows 38 and 42, and 40 and 44.

Figure 4:
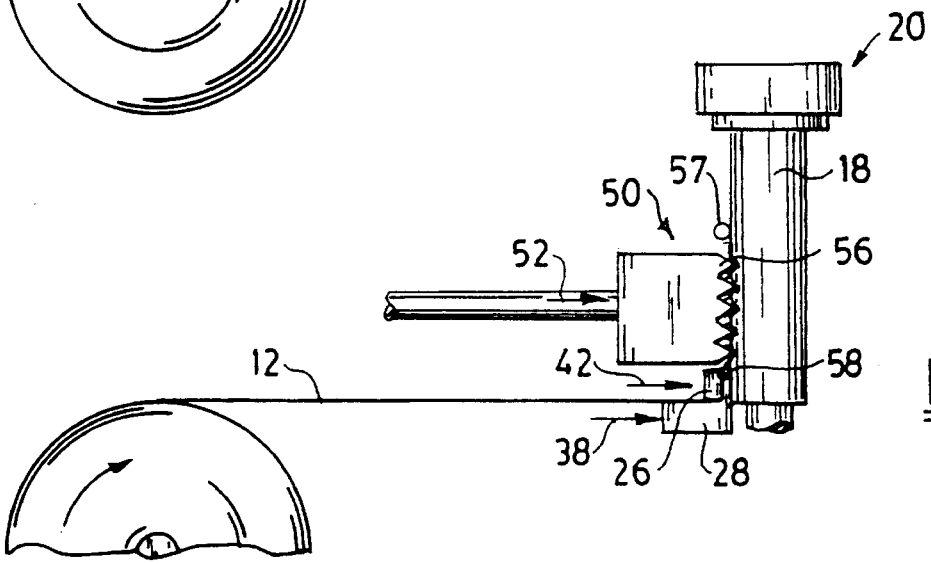

Referring to FIG. 4, clamps 28 and 26 are caused to move in the direction of arrow 38 and 42 until the free, first end 16 of ribbon 12 (see FIGS. 3 and 4) is preferably either contiguous with or nor more than about 0.02 inches away from elongate member 18 of the device 20.

When the free, first end 16 of ribbon 12 is within about 0.02 inches of elongate member 18, a movable hand assembly 50 (see FIG. 1), heated by suitable means, is moved in the direction of arrow 52 until its fingers 56 contact the end 16 and compress it, thereby heat-staking it to elongate member 18. As will be described elsewhere in this specification, this compression and application of heat results in the attachment or heat-staking of ribbon 12 to elongate member 18.

After ribbon 12 has been heat-staked and attached to elongate member 18 as such, jaw 26 moves upwardly in the direction of arrow 33, thereby unclamping from ribbon 12. thereafter, jaw 26, jaw 28, and movable hand assembly 50 move away from member 18 in the direction of arrows 44, 40, and 54, respectively. When these movements have been completed, the jaw 26, the jaw 28, and the movable hand assembly 50 are each in the original position depicted in FIGS. 1 and 7.

Referring to FIG. 1, and in the preferred embodiment illustrated therein, it will be seen that movable hand assembly 50 preferably comprises an upper spring clamp 57 and a lower spring clamp 58, each of which is adapted to contact the free, first end 16 of ribbon 12 (see FIG. 3) and, after such contact, force it into compression with elongate member 18 (see FIG. 3). Each of spring clamps 57 and 58 are resilient. Each of them moves in conjunction with the movable hand assembly 50, but are disposed ahead of the fingers 56 on the assembly 50. Each of them consequently holds the free, first end 16 of ribbon 12 in place prior to the time it is contacted with the fingers 56 of movable hand assembly 50. During the reverse part of the cycle, contact between the movable hand assembly 50 and ribbon 12 is first broken, and then contact between ribbon 12 and clamps 57 and 58 are then broken.

Referring again to FIG. 1, movable hand assembly 50 is preferably heated so that its fingers 56 are at a temperature of from about 380 to about 525 degrees Fahrenheit when they contact the end 16 of ribbon 12. The time of contact required for a satisfactory heat-staked bond varies in a roughly inverse proportion to the temperature. The applicant has achieved attachment in less than 0.2 seconds of contact of fingers 56.

One may use conventional means for heating fingers 56. Thus, for example, a 35 watt soldering iron element may be used and may be kept continually on during the operation of the machine. In this embodiment, to achieve an optimum temperature, a normally 120 volt soldering iron element was operated at 80 volts a.c.

Referring again to FIGS. 3 and 4, it will be seen that, prior to the time ribbon 12 is heat-staked to elongate support member 18, it is preferably substantially parallel to the longitudinal axis 36 of the elongate support member 18. As used herein, the term substantially parallel means that end portion 16 may form an angle of less than about 30 degrees and, more preferably, less than about 15 degrees with axis 36. In the most preferred embodiment, end portion 16 forms an angle of less than about 5 degrees with axis 36, and is therefore substantially parallel thereto.

FIG. 6 illustrates a preferred orientation of the end 16 vis-a-vis support member 18. As will be apparent, end 16 is disposed non-circumferentially vis-a-vis support member 18. By comparison, and for the sake of illustration, the end 16' is shown in a circumferential and conventional orientation, being disposed at an angle of about 90 degrees to axis 36 which makes it easy to wind about member 18, however in this orientation, when ribbon 12 has been unwound and a force applied substantially parallel to axis 36, the ribbon 12 will tend to peal off and thereby break the heat-staked bond.

Referring again to FIG. 6, it will be seen that a portion of the free, first end 16 of ribbon length 12 is melted and joined or heat-staked selectively to elongate support member 18. Heat-staked portions 66 of the end 16 of ribbon 12 are as such surrounded by non-heat staked portions 68.

It is critical in the practice of applicant's invention that there will be at least two heat-staked portions 66 separated from each other by at least one unstaked portion 68. In the most preferred embodiment there are at least 14 heat-staked portions 66 as depicted in FIGS. 6 and 7.

Referring again to FIG. 6, and in the preferred embodiment illustrated therein, it will be seen that the heat-staked portions 66 are formed in columns that are vertical. Further, vertically adjacent columns consist of heat-staked areas 66 that are staggered, i.e., there are no horizontally aligned heat-staked areas in the adjacent columns. The columns are substantially parallel to axis 36.

As will be apparent to those skilled in the art, the elongate member 18 in FIG. 6 has been rotated 90 degrees from its position in FIG. 5 to better illustrate the preferred heat-staking which occurs. A similar position is shown in FIG. 7, where the rotation of the member 18 in the direction of arrow 60 is shown in its first stages of winding up the ribbon 12. FIG. 8 illustrates the end of the process, wherein ribbon 12 has been wound circumferentially upon itself forming coil 72 and then cut, thereby forming ribbon tether 12'.

Without wishing to be bound to any particular theory, applicant believes that the heat-staked portions 66 of ribbon 12 as depicted in FIG. 6 whereby a triangular pattern is formed by the selectively heat-staked portions, nearest to the first end of elongate member 18, assist the remainder of ribbon 12 in folding upon itself in an approximate 90 degree angle (see FIG. 7) for the purpose of easily winding the ribbon upon itself to form coil 72 as depicted in FIGS. 8 and 9.

In one preferred embodiment the outermost heat-staked portions or areas 66 define a figure having a total area such that heat-staked portions within said figure have areas which should not add to more than one-half the total area of said figure. Excessive heat-staked areas reduce the non-heat-staked areas and thereby create weak points where the ribbon may break when tension is applied.

Figure 10:
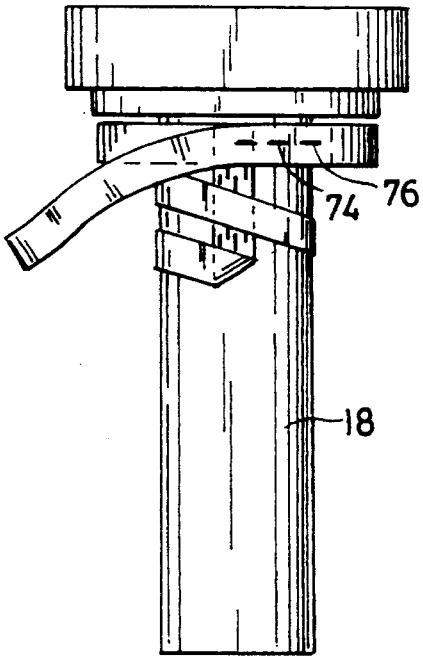
FIG. 10 is a side view of a balloon support structure to which a heat-staked ribbon tether has been attached at a location different than that depicted in FIGS. 1–9.

Referring to FIG. 8, and in the preferred embodiment illustrated therein, after a desired length of ribbon 12 has been wound around elongate member 18, one or more hand assemblies, (not shown), similar to hand assembly 50 and fingers 56, is brought into contact with an outer perimeter of coil 72; thereby forming a removable heat-staked attachment at selected portions 76 to intermediate portion 73 of ribbon 12. In FIG. 8, two adjacent columns of three heat-staked portions are digitated circumferentially relative to the elongate support member 18. By contrast, FIG. 10 depicts one column of digitated heat-staked portions 76. The size and number of heat-staked portions, the time of contact, the amount of pressure, and the temperature of the hand assembly (not shown) influence the ease of subsequently detaching the free end 74 from ribbon coil 72 when a toy balloon assembly on it is about to be used.

FIG. 9 is a bottom view of FIG. 8. In one preferred embodiment, heat-staked portions 76 penetrate additional underlying layers of ribbon coil 72 and thereby discourage coning of coil 76. In another preferred embodiment there are two sets of opposed heat-staked portions 76, as shown in FIG. 9. Both embodiments tend to prevent the coil from forming a cone and reduce the possibility of ribbon tether 12' unwinding prematurely.

After ribbon 12 has been removably secured at portions 76 by heat-staking, or any other means, ribbon 12 is cut (by means not shown) at point 75 (see FIG. 1.) forming second end 74 of ribbon tether 12'. Second end 74 can be pulled free of coil 72 and thereby unwinding ribbon tether 12'.

FIG. 10 is a side view of elongate support structure 18 onto which ribbon 12 has been heat-staked and then wound in a different position than shown in FIG. 8. Coil 72, being positioned adjacent to a change in bore size is therefore afforded protection from being deformed into a cone, (and possibly unwind prematurely) in one direction by the support offered by the change in bore size.

Figure 11:
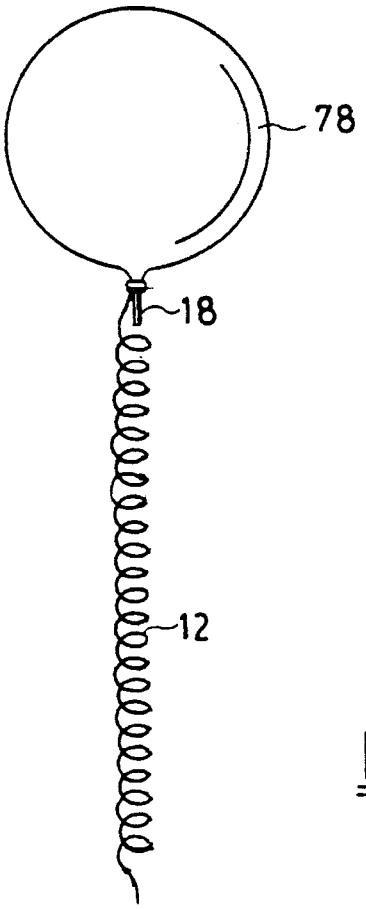
FIG. 11 is a side view of a helium filled balloon which has ascended and caused its tether to unwind.

FIG. 11 illustrates a toy balloon 78 attached to balloon support assembly 20 having elongate member 18 which projects longitudinally from the balloon and, in turn, is connected to heat-staked ribbon tether 12'. It is preferred in such use that ribbon tether 12' have a length of from about 36 to about 50 inches, and a width of approximately 3/16ths of an inch to meet unwritten industry standards. Currently manufactured curling ribbon has thickness of from about 0.004 to about 0.007 inches. In one preferred embodiment, the width is about 0.125 inches for the purpose of reducing weight.

In one preferred embodiment, the elongate support assembly 18 is a valve assembly such as that disclosed in applicant's copending patent application 08/218,270, entitled "Balloon Valve Assembly", which was filed on Mar. 25, 1994. This balloon valve assembly is comprised of a valve device. The valve device contains a substantially non-circular head portion integrally formed with a stem portion and a mounting post adapted to receive a flap valve.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A toy balloon support assembly having a safe and effective heat-staked tether, the support assembly comprising;

a) an elongate support member for supporting a toy balloon, said elongate member including a first end for projecting longitudinally from the toy balloon and a second end for projecting longitudinally into the toy balloon; and b) a ribbon tether consisting of a length of ribbon having a first end and a second end, said first end of ribbon tether being aligned against said first end of said elongate member, and said first end of said ribbon tether, as aligned, including an area thereof heat-staked to said first end of said elongate member, wherein said first end of said ribbon tether is disposed between said first end of said elongate member and said second end of said elongate member, and extends towards said second end of said elongate member, whereby, when a force is applied to said second end of said ribbon tether in a direction substantially parallel to the axis of said elongate member, said ribbon tether will not peel off from said elongate member.

2. The support assembly of claim 1, wherein said heat-staked area of said first end of said ribbon tether comprises selectively spaced apart heat-staked portions.

3. The support assembly of claim 2, wherein said heat-staked portions are arranged in a plurality of columns parallel to the longitudinal axis of said elongate member.

4. The support assembly of claim 3, wherein heat-staked portions forming any one of said plurality of columns are staggered relative to heat-staked portions forming an adjacent column.

5. The support assembly of claim 4, wherein said selectively heat-staked portions include outermost heat-staked portions defining a figure having a total area, and heat-staked portions within said figure have heat-staked areas that add up to less than one half of said total area of said figure.

6. A toy balloon support assembly having a safe and effective heat-staked tether, the support assembly comprising:

(a) an elongate support member for supporting a toy balloon, said elongate member including a first end for projecting longitudinally from the toy balloon;

(b) a ribbon tether consisting of a length of ribbon having a first end and a second end, said first end of ribbon tether being aligned against said first end of said elongate member, and said first end of said ribbon tether, as aligned, including an area thereof heat-staked to said first end of said elongate member, wherein:

1. said heat-staked area of said first end of said ribbon tether comprises selectively spaced apart heat-staked portions,
2. said heat-staked portions are arranged in a plurality of columns parallel to the longitudinal axis of said elongate member,
3. said heat-staked portions forming any one of said plurality of columns are staggered relative to heat-staked portions forming an adjacent column,
4. said selectively heat-staked portions include outermost heat-staked portions defining a figure having a total area, and heat staked portions within said figure have heat-staked areas that add up to less than one half of said total area of said figure, and an end of said figure located towards a first end of said elongate support member is triangular so as to allow for relatively easy winding of a rest of said ribbon tether circumferentially about said elongate support member.

7. The support assembly claim of 6, wherein a rest of said ribbon tether from said heat-staked first end is wound circumferentially around said elongate support member.

8. The support assembly of claim 7, wherein said rest of said ribbon tether is wound circumferentially about itself on said elongate support member and a second end of said rest of said ribbon tether is removably attached to at least an underlying layer of wound ribbon by heat-staking.

9. The support assembly of claim 8, wherein said heat-staked second end includes selectively heat-staked portions that are digitated and aligned circumferentially relative to said elongate support member.

10. A method of forming a ribbon tether support for safely and effectively securing a ribbon tether to a toy balloon, the method comprising the steps of:

(a) aligning a first end of a ribbon tether in a non-circumferential orientation relative to an elongate support member, (b) heat-staking said first end of said ribbon tether to said elongate support member in said aligned non-circumferential orientation, wherein:

1. said elongate support member includes a first end for projecting longitudinally from the toy balloon and a second end for projecting longitudinally into the toy balloon, and
2. said ribbon tether consists of a length of ribbon having said first end and a second end, said first end of said ribbon tether being aligned against said first end of said elongate member, and said first end of said ribbon tether, as aligned, including an area formed by said heat-staking operation, wherein said first end of said ribbon tether is disposed between said first end of said elongate member and said second end of said elongate member and extends towards said second end of said elongate member, whereby, when a force is applied to said second end of said ribbon tether in a direction substantially parallel to the axis of said elongate member and away from said second end of said elongate member, said ribbon tether will not peel off from said elongate member.

11. The method of claim 10, wherein said heat-staking step comprises selectively heat-staking portions of the first end of the ribbon tether to correspondingly aligned portions of a first end of the elongate support member.

12. The method of claim 11, wherein said heat-staking step comprises selectively heat-staking portions arranged in a plurality of columns parallel to the longitudinal axis of the elongate support member.

13. The method of claim 12, wherein said heat-staking step comprises heat-staking portions arranged such that each column has heat-staked portions that are staggered relative to the heat-staked portions of an adjacent column.

14. The toy balloon support assembly as recited in claim 1, wherein said assembly further comprises a toy balloon attached to said second end of said elongate support member.

15. A toy balloon support assembly comprising:

(a) an elongate support member for supporting a toy balloon, said elongate support member including a first end for projecting longitudinally from the toy balloon, and a second end for attaching to the toy balloon; and (b) a ribbon tether consisting of a length of ribbon having a first end and a second end, said first end being attached to said first end of said elongate support member, a remainder portion of said ribbon tether being wound around said support member and upon itself, and said second end of said ribbon being removably heat-sealed to at least two underlying layers of the wound remainder portion in order to discourage coning of the wound portion of said ribbon tether and to thereby reduce the possibility of premature unwinding.

* * * * *